United States Patent [19]

Schulz

[11] Patent Number: 4,592,321

[45] Date of Patent: Jun. 3, 1986

[54] METHOD AND SYSTEM FOR CONTROL OF IDLE SPEED OF AN INTERNAL COMBUSTION ENGINE

[75] Inventor: Alfred Schulz, Oberriexingen, Fed. Rep. of Germany

[73] Assignee: Robert Bosch GmbH, Stuttgart, Fed. Rep. of Germany

[21] Appl. No.: 583,819

[22] Filed: Feb. 27, 1984

[30] Foreign Application Priority Data

Mar. 30, 1983 [DE] Fed. Rep. of Germany ..... 3311550

[51] Int. Cl.[4] ..... F02D 9/02

[52] U.S. Cl. ..... 123/339

[58] Field of Search ..... 123/339, 585

[56] References Cited

U.S. PATENT DOCUMENTS

| | | | |
|---|---|---|---|
| 4,418,665 | 12/1983 | Nagase | 123/339 |
| 4,444,168 | 4/1984 | Matsumura et al. | 123/339 |
| 4,513,710 | 4/1985 | Kobayashi et al. | 123/339 |

FOREIGN PATENT DOCUMENTS

| | | | |
|---|---|---|---|
| 3124496 | 1/1983 | Fed. Rep. of Germany . | |
| 146025 | 11/1981 | Japan | 123/339 |
| 2085619 | 4/1982 | United Kingdom | 123/339 |

*Primary Examiner*—Tony M. Argenbright

*Attorney, Agent, or Firm*—Frishauf, Holtz, Goodman & Woodward

[57] ABSTRACT

A controller (13) provides control signals to an engine (E) to control its idling speed. To provide for additional fuel under special operating conditions—e.g. low engine temperature, starting conditions, placement of a sudden load such as connection of an air-conditioner or the like—a modification signal is generated in signal generators (**17, 18, 19 . . . 19*n*) which signals are introduced into the path of the signals from the idle or command function generator (11) to a positioning element (15) which controls fuel supply to the engine. The engine itself can provide at least some of the signals to the function generators, for example by engine temperature transducers (ETt); engine speed transducers (ETn), to provide engine temperature signals. Starting can be sensed by sensing both engine speed and temperature, and/or operation of the starting switch. An additional function generator (19) is preferably provided to prevent overshoot of the positioning element (15**) if the accelerator pedal is suddenly released, thus preventing stalling of the engine.

12 Claims, 2 Drawing Figures

METHOD AND SYSTEM FOR CONTROL OF IDLE SPEED OF AN INTERNAL COMBUSTION ENGINE

Reference to related patent, the disclosure of which is hereby incorporated by reference, assigned to the assignee of the present application: U.S. Pat. No. 4,359,991, HAUBNER et al.

Reference to related publication: German Patent Disclosure Document DE-OS No. 31 24 496, HAUBNER, assigned to the assignee of the present application.

The present invention relates to a method to control idle speed of an internal combustion engine and a system for such control, and carrying out the method.

BACKGROUND

Internal combustion engines which are not loaded must operate, when idling, at predetermined idling speeds. These idling speeds are not necesarily always the same, but may change with operating conditions, and environmental conditions in which the engine operates, for example temperature. Idling speed control systems have previously been proposed, see the referenced U.S. Pat. No. 4,359,991, HAUBNER et al., the disclosure of which is hereby incorporated by reference; and see, for example, German Patent Disclosure Document DE-OS No. 31 24 496, HAUBNER, likewise assigned to the assignee of the present application. The control effect of an engine operating controller must be matched to the required performance of the engine, for example to so control engine operation that riding comfort and freedom from shock and vibration of occupants of an automotive vehicle, in which such an engine may be installed, are considered. The control behavior of the controllers thus must be matched to particular requirements, including special conditions which may arise in the operation of the engine or in view of environmental conditions. The operating changes can be controlled, for example, by specifically controlling the characteristics of engine controllers, particularly characteristics of integrators, differentiators, or proportional controllers, or elements therein. Thus, the proportional control, integrating or differential control based on input parameters, can be modified. The various characteristics can be interrelated with respect to each other, for example in dependence on operating or environmental parameters, such as ambient temperature. Various types of systems are known, which are more or less complex, in order to match the behavior of the controller to predetermined parameters, and external and operating conditions of the engine. Usually, the requirement of material and networks in substantial. The reaction time of the controller also must be considered. It is usually desirable that the controller reacts rapidly to changes in the actual operating conditions without, however, having the tendency to overshoot; instability of operation should be avoided, for example due to excessively rapid response and consequent overshoot of the controller.

THE INVENTION

It is an object to so arrange a controller that it is simple, responds with sufficient speed, yet avoids overshoot, and requires only a minimum of operating elements.

Briefly, at least one function generator is provided, connected to receive at least one actual engine operating parameter signal, such as temperature, instantaneous speed, or the like. The function generator generates a modification output signal which is representative of the functional relationship of the specific operation parameter—for example temperature or speed—which is represented by the actual engine operating parameter signal, and positioning of an engine control element to obtain a desired engine operating characteristic. The modification output signal then is utilized to modify an engine control signal within an engine control loop, for example by being coupled between an actual-command comparator and an engine control element to modify the engine signal derived from the command/actual engine operating signal comparator.

The engine, thus, is controlled in accordance with the method by generating an engine control signal which controls engine operation. An engine operating parameter is sensed, and a modification signal representative of a function of the engine operation in relation to the operating parameter is derived, the engine operation then being modified in accordance with the modification signal.

The system has the advantage that, since an engine controller is used, and it basically controls the engine, its response can be so arranged, or the controller can be so dimensioned, that the response is comparatively slow; further, the controller can be simply constructed, since deviations from control effects thereof, due to the modification signals, will be rather small. The controller supports the overall control effects, for example due to the modification signal, and is available to support stable operation, for example, even under extreme situations. Only minimum network and material requirements are necessary to include the modification, since specific characteristics of the respective control paths can be easily accomodated by utilizing suitable given parameters which are entered into the controller.

In accordance with a particularly desirable embodiment, modification, or additional control parameters, provides signals depending on actual engine speed, engine temperature, and/or ambient or external temperature, functions dependent on operating conditions, such as when the engine is just being started, or loading conditions under which the engine then operates. Various such operating parameters can be combined, as desired, to provide for optimum matching of modification of engine control signals to the desired result.

DRAWINGS

FIG. 1 is a schematic block circuit diagram of the system in accordance with the invention; and FIG. 2 is a signal diagram in which the abscissa represents engine speed and the ordinate a positioning value of an engine control element, and used in connection with operation or controlling of actual engine idling speed based on modifying parameters.

DETAILED DESCRIPTION

Figure 1:
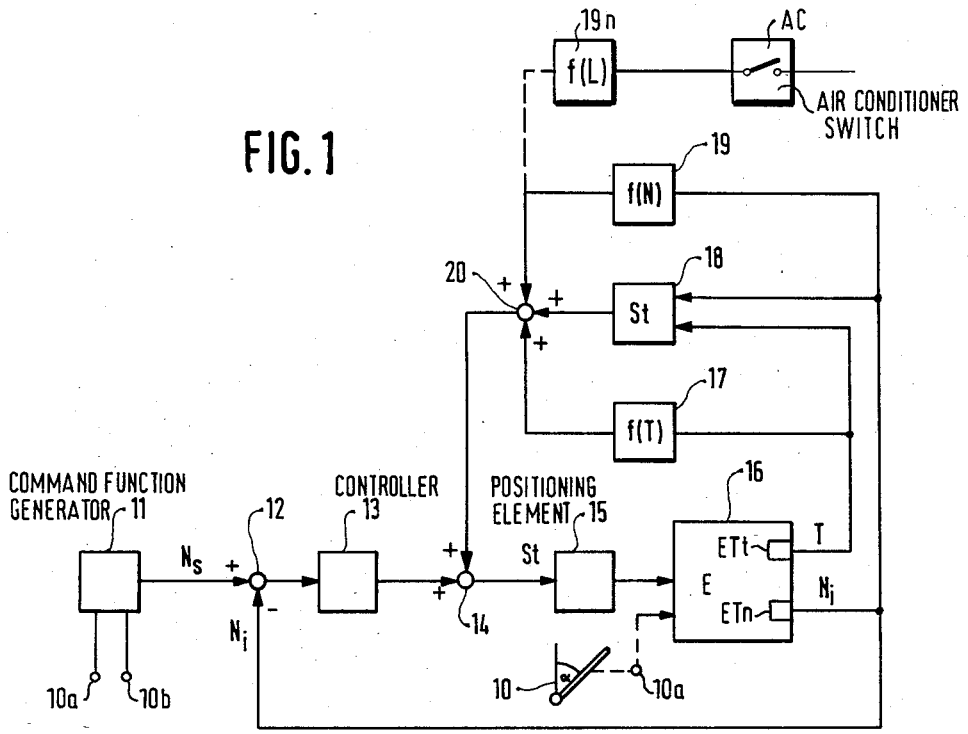

A command function generator 11 receives command signals, for example derived from the angular position of an operator-controlled pedal, such as the accelerator pedal 10; additional command values may be entered therein, for example a fixed value representative of a specific idling speed, schematically represented by input **10*b*. This input, of course, can be derived within the function generator 11** in form of a fixed command signal or command value, such as an independently internally set voltage.

The output signal Ns, which is a command signal which may depend on various operating parameters, for example engine temperature, loading conditions, or the like, when the engine is in operation, is conducted to a comparator 12. The comparator 12 compares the commanded signal with an actual engine operating signal Ni, and provides a comparison output control signal to a first controller 13. The first controller 13 has its output signal connected to a second comparator 14. The comparator 14 may, also, function as an adder. The controller 13 has, as desired for operation of the engine, proportional and/or integrating and/or differentiating characteristics. The details of the controller do not form a part of the present invention and reference is made to the above-referenced U.S. patent. The controller may be of very simple construction, for example having, essentially, proportional transfer characteristics.

The output signal from the second comparator 14 is used to position a positioning element 15 which, in turn, controls the speed N of internal combustion engine (ICE) E, 16. The speed of the engine E can be controlled as well as known, and in accordance with any suitable arrangement, for example, by providing a positioning element 15 which directly changes the position of the throttle plate in the induction pipe of the ICE 16; or which controls a bypass across the throttle of the engine, to be more or less open; or to control the injection intervals, or injection quantity of fuel in a fuel injection system; or to control the ignition timing of the ignition of the ICE, for example by controlling sparking of a spark plug. Direet control of the throttle, or influencing the fuel of a fuel injection system, is effective, by itself; the other functions may additionally be used as auxiliary functions to influence speed of the ICE. The positioning element 15 may be a positioning motor, for example, rotating a throttle plate; it may be a positioning magnet, or a positioning magnet within a hydraulic or pneumatic operating system which has suitably located electromagnetic valves within the hydraulic or magnetic operating system which, in turn, controls the ICE. Similarly, the positioning element may be a pilot positioner which controls, for example by a magnetic valve, a servo system by being located in a fluid control system for actual engine control at a higher power level.

The actual speed of the engine 16 is measured in an engine speed transducer ETn, which will result in an actual engine speed Ni. This actual engine speed signal is conducted to the first comparator 12 which, then, compares the engine speed command signal Ns with the actual engine speed signal. The controller 10, which is operator-controlled, can act directly on the engine E in order to control the engine, for example, for loaded operation under various operating conditions. The output from the operator-controlled pedal 10 can also be applied to the command function generator 11, as shown.

The system, so far described, is conventional and operates in well-known manner, by causing a positioning change in the positioning element 15 when the controller 13 receives an unbalance signal from the command function generator 11 and the actual engine speed signal Ni.

A control loop is formed by the controller 10, the command function generator 11, the engine speed transducer ETn, providing the actual engine speed signal Ni, the comparator 12, the controller 13, and the positioning element 15 and, of course, the engine E.

In accordance with a feature of the invention, and to relieve the control circuit so far described of all control functions so that, even if the controller 13 is somewhat slow to respond, while yet permitting precise and rapid control of engine speed, and to permit, additionally, consideration of special functional effects, an additional modifying function for operation of the positioning element 15, is provided. This additional modifying function is generated by at least one modifying function generator, in the example shown by three function generators **17, 18, 19 . . . 19*n* the output signals of which are summed in a summing circuit 20 and applied from the summing point 20 to the second comparator 14. The comparator 14, as has been noted, may be also connected as an adder to add the signal from junction 20** as a modifying signal. The physical structure of such a unit, whether comparator or adder, can be the same, for example an operational amplifier which has its inputs suitably connected, for example through an inverter, in order to obtain an adding function output.

In accordance with a feature of the invention, an engine temperature-dependent signal T is derived from an engine temperature transducer ETt. This engine temperature signal is continuously obtained from a suitable engine thermostat or other similar transducer and applied to a first modifying function generator 17. The temperature-dependent modifying function signal derived thereby, due to the transfer function f (T) of the generator 17, will modify the signal being applied to the positioning element 15 such that, at low engine temperature, that is, when the engine is still cold, the positioning element 15 will be commanded to control the engine towards a higher idling speed than when the engine is warm. As is well known, when an ICE is cold, a higher quantity of fuel must be supplied thereto than when the engine is at a higher temperature, in order to obtain a given output speed, even under idling conditions. Alternative to engine temperature, or in lieu thereof, or in addition thereto, other temperatures may be considered in the modification of the input signal to the positioning element 15, for example ambient or external or surrounding temperature. Further and other external parameters may also be sensed and applied as a modifying signal, for example ambient air pressure. This is particularly important if the ICE is to operate under conditions of widely varying altitudes above sea level.

A second modifying function generator 18 is provided to generate a start-condition signal. This signal is effective only during starting of the engine. Just after starting, or shortly thereafter, it is disconnected, either abruptly, or slowly, in accordance with a decaying function. Under starting, and in the example shown, the parameters engine speed, signal Ni, and temperature, signal T, are applied to the starting modifying function generator 18. Alternatively, the starting function generator 18 can be triggered or its function-generating output initiated upon connection of the function generator to the starting switch of the ICE, for example by differentiating the impulse upon first connecting the starter of the ICE, and then generating a signal which decays, with time, during a period of normal starting of the engine. A signal may also be generated based on the angular deflection of the operator pedal 10, representative for example of loading on the engine, or a signal representative of induction-type pressure or, rather, vacuum, may be applied to the starting function generator 18. Upon recognition of starting conditions, again, the positioning element 15 will receive a further modification signal in the direction of controlling the positioning element 15 to command engine E to assume a higher speed.

Other special conditions of the ICE can be considered. The starting condition, of course, is one of such special conditions. Preferably, each one of the components of a vehicle in which the ICE is installed, and which, if suddenly connected, cause decrease in engine speed due to the sudden additional loading, could be coupled to a suitable function generator 19*n* which, in turn, has its output coupled to the junction 20 for connection to the summing unit 14 to control the positioning element 15 to increase fuel supply to the engine and thus overcome any drop in speed. Typical devices within the engine which cause sudden decrease in speed thereof due to rapid loading are, for example, air-conditioning units A-C or the like; or auxiliary illumination units which draw a heavy current.

In accordance with a feature of the invention, a third modifying function generator 19 is provided to generate a speed-modifying signal.

Figure 2:
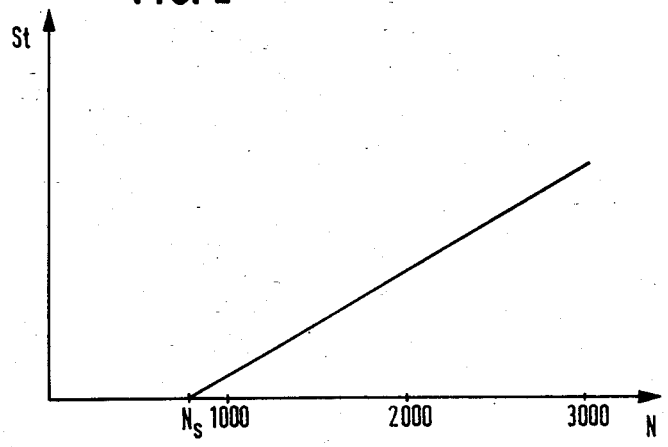

Referring to FIG. 2: A speed-dependent modifying function $f_N$ is shown therein, in which, for example, the operator-controlled pedal 10 has been deflected to a certain angle $\alpha$. After some time, an actual speed level of, for example, 3000 rpm will result. Let it be assumed that the pedal 10 is then suddenly released. The angle $\alpha$ will drop to zero, so that the initially preset idle speed command value Ns of, for example, 750 rpm, will be supplied to the controller 13 from function generator 11. Sudden release of the pedal 10, however, will result in substantial deviation of the control signal. The result may well be that the positioning element 15 returns the fuel supply or throttle very rapidly in the direction of controlling the engine to a low speed, which may include the danger of overshoot; in other words, the actual fuel being supplied to the engine might be insufficient to maintain the engine at the desired idling speed of 750 rpm—a typical idling speed for an automotive-type ICE—and, then, the actual speed would drop below the predetermined idling speed. Due to the generation of the function $f_N$ in function generator 19, a positioning value corresponding to the positioning level St will become effective at the instant of release of the pedal. The function $f_N$ must be so arranged that no stationary speed can result; rather, the function must decline or decay. The output level from the controller 13, due to the large and sudden control deviation—assuming rapid release of the controller 10—will be zero. Yet, the actual speed level is slowly decreased to the desired idling speed level Ns, due to transfer of the signal from function generator 19 through junction 20 and junction 14 to the positioning element 15. It is desirable to so connect the function generator 19 that it becomes effective only when the throttle has been closed, that is, the operator pedal 10 has been released—a condition representing idling speed or, for example, engine braking operating conditions of the vehicle.

The various function generators, the comparator, controller and junction and adding circuits can all be part of a microcomputer, in which the respective parameters can be controlled by suitable pin programming. The transfer functions themselves can readily be stored in commercially available read-only memories (ROMs), which can be made in the form of programmable ROMs (PROMs), to provide for simple association of desired transfer functions to various types of engines with only basic circuit or microprocessor structure.

Various changes and modifications may be made within the scope of the inventive concept.

In an operating embodiment, the following elements were suitable:

command function generator 11, described, for example, in data book of Analog Devices, element AD 7501.

comparator 12: LM 2902 (Tl)

controller 13: LM 2902 (Tl)

junction 14, 20: LM 2902 (Tl)

function generators 17, 18, 19 : LM 2902 (Tl).

I claim:

1. A system, for control of idle speed of an internal combustion engine (E), having:

an operating control element (15) and an engine controller (13) providing an engine control signal, connected to the operating control element of the engine (E) and controlling an operating parameter thereof which affects the operating speed of the engine;

means (10, 11, 10*a*, 10*b*) for generating a speed command signal;

means (ETn, ETt) for generating at least two actual engine operating parameter signals, including an actual speed signal ($N_i$) and a temperature signal (T);

a comparator (12) receiving (a) the speed command signal ($N_s$) and (b) the actual engine speed signal ($N_i$) and providing a control output signal representative of the difference between commanded and actual speed signals, said control output signal being applied to said controller (13) as a controlling signal therefor, a first (17) and a second (18) means for producing modifying function signals dependent, respectively, upon engine temperature (T) and actual engine speed ($N_i$);

a third (19*n*) means for producing a modifying function signal dependent upon connection of load-producing vehicle components (AC);

signal combining means (14) receiving output signals from at least said controller (13) and said first, second, and third modifying signal producing means (17, 18, 19*n*) and generating an input signal applied to said engine operating control element (15);

the speed command signal generating means (10, 11, 10*a*, 10*b*), the actual speed ($N_i$) signal generating means (ETn), the comparator (12), the controller (13), the signal combining means (14), the engine control element (15) and the engine defining a control loop; wherein, there is provided a fourth (19) modifying function signal producing means, which applies to said signal combining means (14) an output signal corresponding to a desired minimum idling speed when actual engine speed ($N_i$) is no greater than said desired idling speed, and applies a signal which increases as engine speed increases, whenever engine speed is above said idling speed.

2. System according to claim 1, wherein the temperature signal is a function of the temperature of the engine (E).

3. System according to claim 1, wherein the temperature signal is a function of the ambient temperature in which the engine (E) is located.

4. System according to claim 1, wherein the temperature signal is a composite of the function of the temperature of the engine and the ambient temperature to which the engine is exposed.

5. System according to claim 5, wherein the variation of the modifying signal causes a decrease in the difference between the commanded and output signals derived from the comparator (12) upon operation of the engine in which an engine controller commands essentially only idle speed of the engine.

6. System according to claim 1, wherein one of the function generators provides said modifying output signal while the engine is under starting conditions.

7. System according to claim 1, wherein a plurality of function generators (17, 18, 19 . . . 19*n*) are provided, each providing a respective modifying output signal representative of the functional relationship of an operating parameter represented by the actual engine operating parameter signal associated with any one of the function generators, and the engine operating control element control characteristic;

and wherein all the modifying output signals from said respective function generators are connected to the signal modifying means.

8. System according to claim 7, wherein a combining means (20) is provided, receiving all the modifying output signals from the respective function generators, and providing a combined modifying output signal to the signal modifying means (14).

9. A method of controlling the idle speed of an internal combustion engine (E) having an operating control element (15) and an engine controller (13) providing an engine control signal, connected to the operating control element (15) of the engine (E) and controlling an operating parameter thereof which affects the operating speed of the engine;

means (10, 11, 10*a*, 10*b*) for generating a speed command signal ($N_s$);

means (ETn, ETt) for generating at least two actual engine operating parameter signals, including an actual speed signal ($N_i$) and a temperature signal (T);

a plurality of means (17, 18, 19, 19*n*) for producing modifying function signals dependent upon said actual engine operating parameter signals;

a comparator (12) receiving (a) the speed command signal ($N_s$) and (b) the actual engine speed signal ($N_i$) and providing a control output signal representative of the difference between commanded and actual speed signals, said control output signal being applied to said controller (13) as a controlling signal therefor;

and signal combining means (14) having inputs connected to said controller (13) and to said means (17, 18, 19, 19*n*) for generating modifying function signals, and an output connected to said engine operating control element (15), the speed command signal generating means (10, 11, 10*a*, 10*b*), the actual speed signal ($N_i$) generating means (ETn), the comparator (12), the controller (13), the signal combining means (14), the engine control element (15) and the engine (E) defining a control loop; comprising, the steps of:

generating (11) an engine control signal to control the engine operation;

providing (19) a desired minimum idling speed;

sensing engine operating parameters, including actual engine speed ($N_i$), auxiliary loads (L), and temperature (T);

generating modifying function signals from said sensed parameters, including comparing (19) said actual engine speed ($N_i$) with said desired minimum idling speed and producing a modifying speed function signal which corresponds to a desired minimum idling speed when actual engine speed ($N_i$) is no greater than said desired idling speed and which increases as engine speed increases, whenever engine speed is above said desired minimum idling speed;

deriving a modification signal by combining (20) said modifying function signals;

and modifying the operation of the operating control element (15), and hence engine operation, by introducing (14) said modification signal into said control loop.

10. A method according to claim 9, wherein the step of sensing said engine operating parameters comprises sensing (ETn) actual engine speed ($N_i$); and sensing (ETt) a temperature relevant to engine operation;

and the step of deriving the modification signal comprises generating a modification signal as a funcion of engine operation with respect to both actual temperature; and a change in actual engine operating speed resulting from a sudden change in the value of a controlling signal (10*a*) in a direction tending to decrease engine speed.

11. A method according to claim 9, wherein the step of sensing said engine-operating parameters comprises sensing starting conditions of the engine; and the step of deriving a modification signal comprises generating a signal tending to increase fuel supply to the engine.

12. A method according to claim 9, wherein the step of sensing said engine operating parameters comprises sensing a sudden change in loading being placed on the engine;

and the step of deriving the modification signal comprises increasing the fuel supply to the engine to maintain idling speed thereof at a predetermined level.

* * * * *

UNITED STATES PATENT AND TRADEMARK OFFICE

CERTIFICATE OF CORRECTION

PATENT NO. : 4,592,321

DATED : June 3, 1986

INVENTOR(S) : Alfred SCHULZ

It is certified that error appears in the above-identified patent and that said Letters Patent is hereby corrected as shown below:

Column 7, line 5, (claim 5, line 1) change "claim 5" to -- claim 1 --

Signed and Sealed this

*Thirtieth* Day of *September 1986*

[SEAL]

*Attest:*

DONALD J. QUIGG

*Attesting Officer*

*Commissioner of Patents and Trademarks*